United States Patent [19]

Boulard

[11] Patent Number: 4,952,069

[45] Date of Patent: Aug. 28, 1990

[54] STIRRER, IN PARTICULAR FOR A MICROWAVE OVEN

[76] Inventor: Michel Boulard, 11 rue de Metz 80000, Amiens, France

[21] Appl. No.: 362,158

[22] Filed: Jun. 6, 1989

[30] Foreign Application Priority Data

Jun. 7, 1988 [FR] France ..... 88 07555

[51] Int. Cl.[5] ..... B01F 7/18

[52] U.S. Cl. ..... 366/312; 219/10.55 E; 219/10.55 F; 366/343

[58] Field of Search ..... 366/309, 311, 312, 313, 366/343, 279, 285, 286; 99/348, 277.2, 277.1, 452, 459, 460, 461, 462, 463; 15/246.5; 210/396, 397; 219/10.55 E, 10.55 F

[56] References Cited

U.S. PATENT DOCUMENTS

| | | | |
|---|---|---|---|
| 2,011,699 | 8/1935 | Amend . | |
| 2,027,756 | 1/1936 | Tay . | |
| 3,357,685 | 12/1967 | Stephens | 99/348 |
| 4,552,461 | 11/1985 | Ott | 366/312 |
| 4,693,610 | 9/1987 | Weiss | 99/348 |
| 4,808,005 | 2/1989 | Lewis | 366/312 |
| 4,832,501 | 5/1989 | McCauley | 99/348 |

FOREIGN PATENT DOCUMENTS

| | | | |
|---|---|---|---|
| 0046477 | 3/1982 | European Pat. Off. . | |
| 1810783 | 11/1970 | Fed. Rep. of Germany . | |
| 3033778 | 9/1982 | Fed. Rep. of Germany . | |
| 19617 | of 1896 | United Kingdom | 99/348 |

*Primary Examiner*—Robert W. Jenkins

*Attorney, Agent, or Firm*—Sixbey, Friedman, Leedom & Ferguson

[57] ABSTRACT

A stirrer comprises a frame fixed to a drive shaft (6) including coupling means (18) for coupling the drive shaft to a drive motor (8), and according to the invention the stirrer includes at least one bottom scraper segment (15) extending downwards from the frame along a bottom edge thereof, together with adaptor means (14) for changing the distance between the coupling means (18) and a bottom edge (19) of the bottom scraper segment.

3 Claims, 1 Drawing Sheet

STIRRER, IN PARTICULAR FOR A MICROWAVE OVEN

The present invention relates to a stirrer, in particular for a microwave oven comprising an enclosure in which a receptacle is disposed, the stirrer serving to stir the substance contained in the receptacle while it is being heated by means of microwaves.

BACKGROUND OF THE INVENTION

In order to obtain uniform heating in a microwave oven, not only is it desirable to provide a wave spreader, it is also desirable to stir the substance contained in the receptacle.

In French patent number 2 588 063 the Applicant has already proposed a solution consisting in providing a microwave oven including a moving sole plate enabling the height at which the substance in the receptacle is stirred to be adjusted at will. However, using an oven with a moving sole plate requires an installation which is large in size and which is not necessary when small and medium quantities of substance are to be treated.

An object of the present invention is to provide a stirrer whose structure enables it to be used in an oven which is small in size.

SUMMARY OF THE INVENTION

In order to achieve this object, the present invention provides a stirrer comprising a drive shaft including coupling means for coupling to a drive motor, a frame associated with the drive shaft and supporting at least one bottom scraper segment which extends downwards from the frame along the bottom edge thereof, in which the bottom scraper segment extends beyond that end of the drive shaft which is furthest from its coupling means, and the stirrer includes adaptor means for changing the distance between the coupling means and a bottom edge of the bottom scraper segment.

Thus, after the stirrer has been put into place in the receptacle and the receptacle has been inserted in the microwave oven, the adaptor means enable the drive shaft to be coupled to the drive motor while nevertheless keeping the bottom scraper segment in contact with the bottom of the receptacle.

In one embodiment of the invention, the top end of the stirrer drive shaft includes two telescopic portions constrained to rotate together. Thus, the telescopic portions enable the length of the drive shaft to be adapted, and thus enable the distance between the coupling means and the bottom edge of the bottom scraper segment to be adapted.

In another embodiment of the invention, the bottom scraper segment is mounted to pivot about a horizontal axis. Thus, when the stirrer is inserted in the receptacle and put into place in the oven, the bottom scraper segment is put into a substantially horizontal position and, when the drive shaft is raised in order to be coupled to the drive motor, the bottom scraper segment pivots in such a manner that its bottom edge remains in contact with the bottom of the receptacle.

In another advantageous embodiment of the invention, the stirrer includes two bottom scraper segments mounted in line with each other and having facing ends, said facing ends including abutments which bear against each other when the bottom scraper segments move towards a vertical position. Preferably, the bottom scraper segments include respective chamfered portions facing the frame. Thus, when the stirrer is withdrawn from the receptacle, the scraper segments come into abutment against each other prior to reaching the vertical position, and they therefore fold up in a privileged direction when next inserted in a receptacle and brought to bear against the bottom thereof, with the chamfered portion then bearing against the bottom of the receptacle while the stirrer is being rotated by virtue of the pressure exerted on the bottom scraper by the substance contained in the receptacle.

BRIEF DESCRIPTION OF THE DRAWING

Embodiments of the invention are described by way of example with reference to the accompanying drawing, in which.

DETAILED DESCRIPTION

Figure 1:
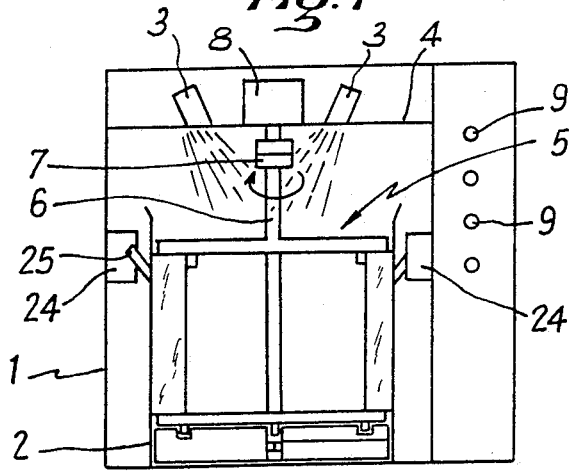
FIG. 1 is a diagram of an oven fitted with a first embodiment of a stirrer in accordance with the invention.

With reference to the figures, the stirrer of the invention is more particularly intended to be used in a microwave oven comprising, in conventional manner, an enclosure 1 in which a receptacle 2 is disposed, and two microwave generators 3 disposed above the receptacle and separated therefrom by a microwave-permeable protective screen 4. A stirrer, given a general reference numeral 5, has a drive shaft 6 which is fixed by a coupling 7 to a drive motor 8. The oven also includes a control circuit associated with control knobs 9.

Figure 2:
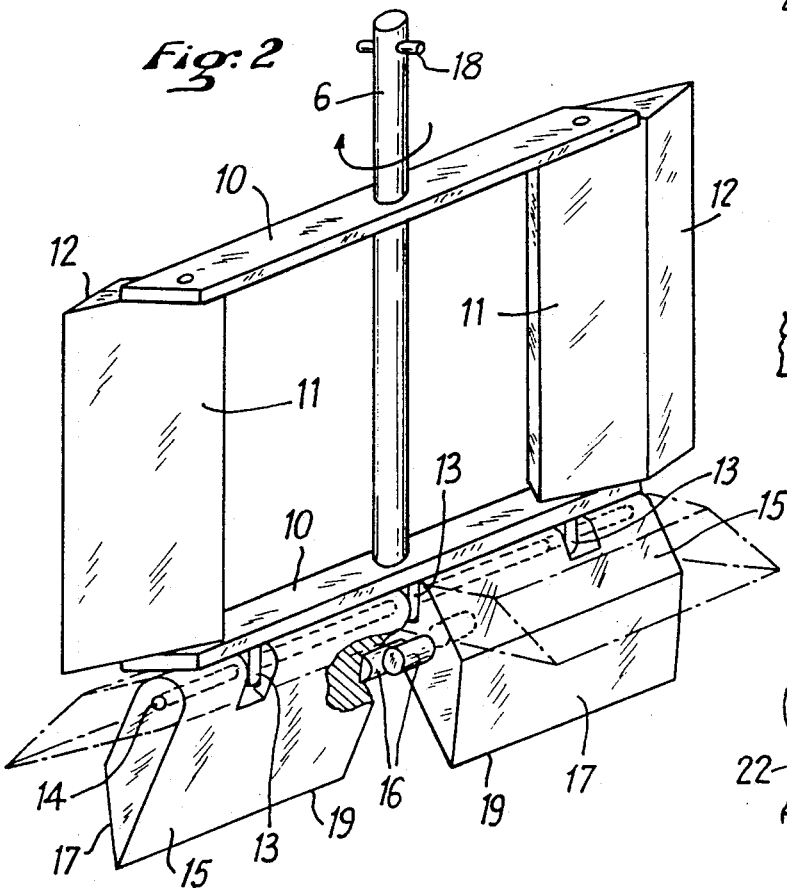
FIG. 2 is a partially cut-away perspective view of a first embodiment of a stirrer in accordance with the invention.

In one embodiment as shown in FIG. 2, the stirrer of the invention comprises a frame constituted by two horizontal cross-members 10 fixed to the drive shaft 6 and supporting lateral scrapers 11 at their ends, the scrapers including chamfered portions 12 facing in opposite directions on upstream faces of the scrapers ("upstream" being relative to the direction of rotation of the drive motor 8). The bottom cross-member 10 has lugs 13 on its bottom face extending downwards and receiving a horizontal hinge pin 14 which they support parallel to the bottom cross-member 10 beyond the end of the drive shaft distant from its end having coupling means 18. Two bottom scraper segments 15 are pivotally mounted on the hinge pin 14, and they include facing ends fitted with abutments 16 which make contact with each other when the stirrer is removed from the receptacle, as shown in solid lines in FIG. 2. The bottom scrapers 15 include chamfered portions 17 directed towards the frame.

It will thus be understood that when the stirrer is removed from the receptacle, the bottom scraper segments remain at a small angle relative to a vertical plane including the drive shaft 6 by virtue of their abutments 16 engaging each other. When the stirrer is inserted in a receptacle, the scraper segments 15 take up a position close to horizontal as shown in dashed lines in FIG. 2. When the coupling means of the drive shaft 6, in this case a transverse pin 18, are raised in order to be fixed to the coupling means 7 of the drive motor 8, the bottom edge 19 of the bottom scraper segments 15 continues to bear against the bottom of the receptacle 2, and the bottom scraper segments 15 automatically take up a slope which is a function of the distance between the bottom of the receptacle 2 and the coupling means 7. When the stirrer is caused to rotate, the substance contained in the receptacle 2 exerts pressure on the chamfered portions 17, and as a result the bottom edges 17 of the scraper segments 15 are pressed firmly against the bottom of the receptacle.

Figure 3:
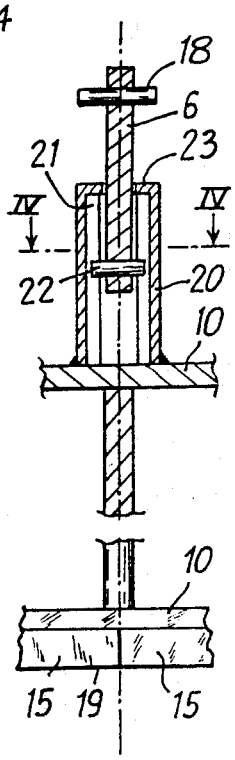
FIG. 3 is a fragmentary section view on a vertical plane including the drive axis through a second embodiment of a stirrer in accordance with the invention.
Figure 4:
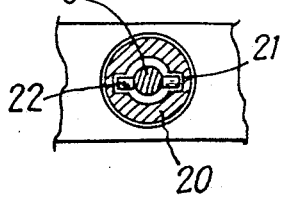
FIG. 4 is a cross-section on line IV—IV of FIG. 3.

In another embodiment shown in FIGS. 3 and 4, the bottom scrapers 15 are now mounted in fixed manner on the bottom cross-member 10 in a horizontal position or in a position having a slight slope, and the means for adapting the distance between the coupling means 18 and the bottom edge 19 of the bottom scraper segments are now constituted by two telescopic portions constrained to rotate together and comprising a tubular sleeve 20 having a vertical groove 21 fixed to the top cross-member 10 and slidably receiving a length of drive shaft 6 including a coupling pin 18 near to its top end and a drive pin 22 near to its bottom end. The drive pin 22 is disposed transversely to the length of drive shaft 6 and engages in the grooves 21 in such a manner that the length of drive shaft 6 is capable of sliding vertically inside the sleeve 20 while nevertheless causing said sleeve to rotate when the drive shaft 6 is itself coupled to the drive motor 8.

In use, this second embodiment of a stirrer in accordance with the invention is inserted in a receptacle and is engaged therein until its bottom scraper segments make contact with the bottom of the receptacle. The length of drive shaft 6 is then raised in order to engage the coupling means 7. Thereafter, when the drive motor 8 rotates, the chamfered portions of the scraper segments 15 keep the scraper in contact with the bottom of the receptacle. Optionally, a spring may also be provided in the sleeve 20 between the top face of the top cross-member 10 and the drive pin 22. Thus, when the drive pin 18 is raised in the coupling means 7, the spring disposed in the sleeve exerts downwards pressure urging the bottom scraper segments 15 into contact with the bottom of the receptacle. In this context, it should also be observed that the sleeve 20 preferably includes a folded-down lip 23 at its top end preventing the length of drive shaft 6 from escaping from the sleeve 20 when the stirrer is removed from the receptacle.

When thick material is to be stirred by the stirrer, the oven preferably includes means for preventing the receptacle 20 from rotating about a vertical axis, e.g. abutment blocks 24 for engaging the handles 25 of the receptacle. Naturally, if the receptacle used does not include a handle, then other means may be provided for preventing the receptacle 2 from rotating about a vertical axis.

The invention is not limited to the embodiments described, and variants may be made thereto without going beyond the scope of the invention. In particular, in order to prevent the bottom scraper segments mounted on a horizontal pin 14 from taking up a vertical position, the abutments 16 may be replaced by a heel provided along the top edge of each bottom scraper segment 15, with said heel bearing against the bottom face of the bottom cross-member 10 when the bottom scraper segments are no longer in contact with the bottom of the receptacle.

The stirrer of the invention may also be fitted with tubular waveguides including wave-receiving openings at their top ends and wave-diffusing openings at one or more points along their side walls in order to distribute microwaves within the bulk of the substance being stirred, as described in my copending patent application filed on the same day as the present application. In addition, the stirrer may be fitted with other accessories, in particular a temperature probe disposed on the surface of the drive shaft 6 or inside it and connected to a measuring device by means of a slip ring disposed in the vicinity of the top end of the drive shaft 6.

I claim:

1. A stirrer comprising a drive shaft including coupling means for coupling to a drive motor, a frame associated with the drive shaft and supporting at least one bottom scraper segment mounted to pivot about a horizontal axis and extending beyond an end of the drive shaft which is furthest from said coupling means, and abutment means for limiting a downward pivoting movement of said at least one bottom scraper segment to a position where said at least one bottom scraper segment remains at an angle relative to a vertical plane.

2. A stirrer according to claim 1, including two bottom scraper segments mounted in line with each other and having facing ends, said facing ends including abutments which bear against each other when the bottom scraper segments move towards a vertical position.

3. A stirrer according to claim 2, wherein the bottom scraper segments include respective chamfered portions facing the frame.

* * * * *